US007381684B2

(12) United States Patent
Tsukida et al.

(10) Patent No.: US 7,381,684 B2
(45) Date of Patent: Jun. 3, 2008

(54) METHOD FOR USING A REWRITABLE THERMAL LABEL

(75) Inventors: Tatsuya Tsukida, Yoshikawa (JP); Tetsuyuki Utagawa, Kawaguchi (JP)

(73) Assignee: Lintec Corporation, Tokyo (JP)

( * ) Notice: Subject to any disclaimer, the term of this patent is extended or adjusted under 35 U.S.C. 154(b) by 0 days.

(21) Appl. No.: 11/093,817

(22) Filed: Mar. 29, 2005

(65) Prior Publication Data

US 2005/0170960 A1 Aug. 4, 2005

Related U.S. Application Data

(62) Division of application No. 10/261,284, filed on Sep. 30, 2002, now Pat. No. 6,956,010.

(30) Foreign Application Priority Data

Oct. 16, 2001 (JP) ..... 2001/318321

(51) Int. Cl.
*B41M 5/40* (2006.01)

(52) U.S. Cl. ..... 503/201; 503/200; 503/217; 503/220; 503/224; 503/226

(58) Field of Classification Search ..... 428/41.6, 428/345, 354, 355 AC; 503/200, 201, 216, 503/220, 224, 226
See application file for complete search history.

(56) References Cited

U.S. PATENT DOCUMENTS 5,296,439 A 3/1994 Maruyama et al.
5,470,816 A 11/1995 Satake et al.
7,018,952 B2 * 3/2006 Tsukida et al. ..... 503/201

FOREIGN PATENT DOCUMENTS

| | | | |
|---|---|---|---|
| EP | 0 735 519 | A2 | 10/1996 |
| EP | 1 031 433 | A2 | 8/2000 |
| JP | 2-116591 | A | 5/1990 |
| JP | 5-53976 | A | 7/1993 |
| JP | 07-172054 | A | 7/1995 |
| JP | 7-172072 | A | 7/1995 |
| JP | 8-25808 | A | 1/1996 |
| JP | 9-11623 | A | 1/1997 |
| JP | 9-95053 | A | 4/1997 |
| JP | 11-058963 | A | 3/1999 |
| JP | 11-286174 | A | 10/1999 |
| JP | 2000-71661 | A | 3/2000 |
| JP | 1 031 443 | A2 | 8/2000 |
| JP | 2000-309169 | A | 11/2000 |
| JP | 2001-071543 | A | 3/2001 |
| JP | 2001-088443 | A | 4/2001 |

* cited by examiner

*Primary Examiner*—Bruce H. Hess
(74) *Attorney, Agent, or Firm*—Frishauf, Holtz, Goodman & Chick, P.C.

(57) ABSTRACT

A method for using a rewritable thermal label of the non-contact type which comprises recording and erasing information repeatedly in accordance with a non-contact method on a rewitable thermal label which remains attached to an adherend. The label contains (a) an anchor coat layer comprising a crosslinked resin, (b) a heat-sensitive color development layer, (c) a light absorption and a photo-thermal conversion layer and (d) an adhesive layer. The layers (a), (b), (c) and (d) are laminated on a first face of a substrate successively. The anchor coat layer is placed next to the substrate. The layer (c) is an outermost layer. The adhesive layer is placed on a second face of the substrate.

22 Claims, 1 Drawing Sheet

METHOD FOR USING A REWRITABLE THERMAL LABEL

CROSS-REFERENCE TO RELATED APPLICATION

This application is a divisional application of application Ser. No. 10/261,284 filed on Sep. 30, 2002 now U.S. Pat. No. 6,956,010.

BACKGROUND OF THE INVENTION

1. Field of the Invention

The present invention relates to a rewritable thermal label of the non-contact type and, more particularly, to a rewritable thermal label of the non-contact type which allows recording and erasure of information repeatedly in accordance with the non-contact method while the rewritable thermal label remains attached to an adherend, allows using a substrate having a poor solvent resistance and can be recycled together with the adherend.

2. Description of Related Art

Currently, labels for control of articles such as labels attached to plastic containers used for transporting foods, labels used for control of electronic parts and labels attached to cardboard boxes for control of distribution of articles are mainly labels having a heat-sensitive recording material such as direct thermal paper as the face substrate. In the heat-sensitive recording material, a heat-sensitive recording layer containing an electron-donating dye precursor which is, in general, colorless or colored slightly and an electron-accepting color developing agent as the main components is formed on a support. When the heat-sensitive recording material is heated by a heated head or a heated pen, the dye precursor and the color developing agent react instantaneously with each other and a recording image is obtained. When an image is formed on the heat-sensitive recording material, in general, it is impossible that the formed image is erased so that the condition is returned to that before the image is formed.

In the label for control of articles described above, the face substrate is formed mainly by using the above heat-sensitive recording material. Informations such as the addresses to be sent, the name of the sender, the number and the lot number and a bar code expressing the informations are printed on the label using a thermal printer of the contact type and the label having the printed information is attached to an adherend. When the label completes the expected role, the label is manually removed from the adherend such as a container and a card board box to reuse the adherend and great amounts of labor and time are required for the removal of the label. To the adherend from which the label has been removed, another label printed by using a thermal printer of the contact type is attached and the adherend is reused repeatedly in this manner.

It is the actual situation that a label is attached and removed every time an adherend is used. A rewritable thermal label which allows repeated recording and erasure of information while the label remains attached to the adherend, without removing the label every time the adherend is used, has been desired.

On the other hand, in recent years, reversible heat-sensitive recording materials which allow recording and erasure of an image, such as (1) a reversible heat-sensitive recording material having a heat-sensitive layer which is formed on a substrate and contains a resin and an organic low molecular weight substance showing reversible changes in transparency depending on the temperature and (2) a reversible heat-sensitive recording material having a heat-sensitive color development layer which is formed on a substrate and contains a dye precursor and a reversible color developing agent, have been developed.

When the above reversible heat-sensitive recording material is applied to the above rewritable thermal label, it is required that information be recorded and erased in accordance with the non-contact method since the information is recorded and erased while the label remains attached to an adherend. Therefore, the reversible heat-sensitive recording material described above in (2) is preferable.

However, in the reversible heat-sensitive recording material described above in (2), a coating fluid prepared by dissolving or dispersing a dye precursor, a color developing agent and other additives used where necessary in a solvent such as tetrahydrofuran is used for forming the heat-sensitive color development layer. Therefore, films of resins which are mainly used for the substrate such as polystyrene, acrylonitrile-butadiene-styrene copolymers (ABS resins) and polycarbonates cannot be used due to the poor resistance to solvents and the resin used for the substrate is limited to resins having the excellent resistance to solvents such as polyethylene terephthalate and polypropylene. Thus, the above reversible heat-sensitive recording material has a drawback in that the type of the resin used for the substrate is limited. To use the above resins mainly used for the substrate of the label as the substrate of the above label, it is necessary that the resistance to solvents be improved.

In general, laser beam is used for recording information in accordance with the non-contact method using the reversible heat-sensitive recording material described above in (2). Therefor, it is important that the material has the function of absorbing laser beam and efficiently converting the absorbed laser beam into heat.

Moreover, it is required that the adherend such as a plastic container be recycled after the use so that the society of the resources-recycling type can be constructed. When the plastic container is recycled, it is desirable that the rewritable thermal label can be recycled together with the adherend while the label remains attached to the adherend.

SUMMARY OF THE INVENTION

The present invention has an object of providing a rewritable thermal label of the non-contact type which allows repeated recording and erasure of information in accordance with the non-contact method on the label which remains attached to an adherend, allows the use of a substrate having poor resistance to solvents and can be recycled together with the adherend.

As the result of intensive studies by the present inventors to develop a rewritable thermal label of the non-contact type exhibiting the above excellent functions, it was found that the object can be achieved with a label having a specific laminate structure. The present invention has been completed based on this knowledge.

The present invention provides:

(1) A rewritable thermal label of a non-contact type which comprises an anchor coat layer comprising a crosslinked resin, a heat-sensitive color development layer and a light absorption and photo-thermal conversion layer which are laminated on one face of a substrate successively, the anchor coat layer being placed next to the substrate, and an adhesive layer placed on an other face of the substrate and allows recording and erasure of information repeatedly in accordance with a non-contact method;

(2) A label described in (1), wherein the crosslinked resin in the anchor coat layer has a degree of crosslinking expressed as a gel fraction of 30% or greater;
(3) A label described in any of (1) and (2), wherein the heat-sensitive color development layer comprises a dye precursor and a reversible color developing agent;
(4) A label described in any of (1), (2) and (3), wherein the light absorption and photo-thermal conversion layer comprises a light absorbing agent comprising at least one of organic dyes and organometallic coloring matters;
(5) A label described in any of (1) to (4), wherein the substrate is made of a same material as a material of an adherend;
(6) A method for using a rewritable thermal label of a non-contact type which comprises recording and erasing information repeatedly in accordance with a non-contact method on a rewritable thermal label described in any of (1) to (5) which remains attached to an adherend; and
(7) A method described in (6), wherein the information is recorded with laser beam having a wavelength of oscillation of 700 to 1,500 nm.

Figure 1:
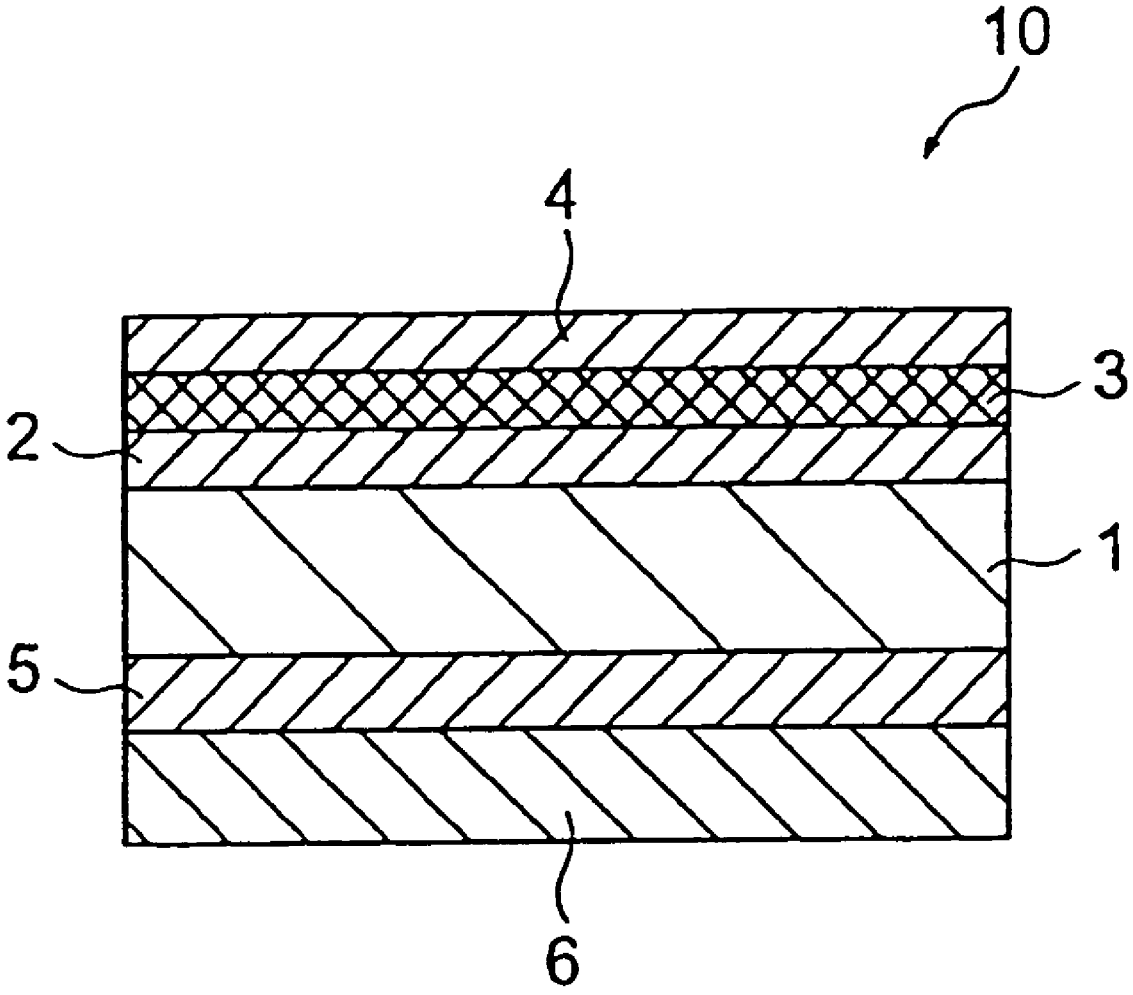
FIG. 1 shows a sectional view exhibiting an embodiment of the construction of the rewritable thermal label of the non-contact type of the present invention.

The numbers in FIG. 1 have the following meanings:

1: A substrate
2: An anchor coat layer
3: A heat-sensitive color development layer
4: A light absorption and photo-thermal conversion layer
5: An adhesive layer
6: A release sheet

DESCRIPTION OF THE PREFERRED EMBODIMENTS

The substrate in the rewritable thermal label of the non-contact type of the present invention is not particularly limited and any of substrates having excellent resistance to solvents and substrates having poor resistance to solvents can be used. Examples of the substrate include plastic films such as films of polystyrene, ABS resins, polycarbonates, polypropylene, polyethylene and polyethylene terephthalate, synthetic papers, non-woven fabrics and paper. For the substrate, the same material as that for the adherend is preferable so that the substrate can be recycled together with the adherend. The thickness of the substrate is not particularly limited. The thickness is, in general, in the range of 10 to 500 μm and preferably in the range of 20 to 200 μm.

When a plastic film is used as the substrate, where desired, a surface treatment such as an oxidation treatment and a roughening treatment may be conducted to improve adhesion with the anchor coat and the adhesive layer which are placed on the surfaces. Examples of the oxidation treatment include the treatment with corona discharge, the treatment with chromic acid (a wet process), the treatment with flame, the treatment with heated air and the treatment with ozone in combination with irradiation with ultraviolet light. Examples of the roughening treatment include the treatment by sand blasting and the treatment with a solvent. The surface treatment can be suitably selected in accordance with the type of the substrate. In general, the treatment with corona discharge is preferable from the standpoint of the effect and operability.

To effectively utilize the converted heat during the recording of information with laser beam, it is effective that a foamed plastic film having a great heat insulating effect is used for the substrate. Although a plastic film is preferable for the substrate, a paper substrate may also be used advantageously when the number of repeated use is not great.

In the rewritable thermal label of the present invention, an anchor coat layer is formed on one face of the substrate. The anchor coat layer is formed to protect the substrate from a solvent in a coating liquid when a heat-sensitive color development layer is formed in the next step. A substrate having poor resistance to solvents can be used since the anchor coat layer is formed.

The resin constituting the anchor coat layer is not particularly limited and various types of resin can be used. In the present invention, a crosslinked resin having excellent resistance to solvents is used. Examples of the crosslinked resin include acrylic resins, polyester resins, polyurethane resins and ethylene-vinyl acetate copolymers which are crosslinked. When a material having poor resistance to solvents is used as the substrate, it is preferable that a coating fluid not using an organic solvent such as a coating fluid of an aqueous solution or an aqueous dispersion is used for forming the anchor coat layer. The process for forming the crosslinking is not particularly limited and a process can be selected from various conventional processes in accordance with the type of the resin.

It is also effective that a resin curable by crosslinking with ionizing radiation such as ultraviolet light and electron beam is used for coating without solvents. When the resin curable with ionizing radiation is used, the degree of crosslinking can be easily adjusted by changing the amount of irradiation and, moreover, a crosslinked resin having a great crosslinking density can be formed.

In the present invention, it is preferable that the degree of crosslinking of the crosslinked resin forming the anchor coat layer is 30% or greater and more preferably 40% or greater as the gel fraction measured in accordance with the following method. When the gel fraction is smaller than 30%, the resistance to solvents is insufficient and there is the possibility that the substrate cannot be protected sufficiently from the solvent of the coating fluid used for forming the heat-sensitive color development layer in the next step.

<Method for Measuring the Gel Fraction>

A coating liquid for forming the anchor coat layer is applied to a release film. After the formed coating layer is treated for crosslinking under the same condition as that for forming the anchor coat layer in the present invention, the crosslinked resin (50 mm×100 mm) is peeled from the release film. Using a metal net of 200 mesh having a size of 100 mm×130 mm, two sheets of the above crosslinked resin (the total weight: A g) are wrapped with the metal net, set into a Soxhlet extractor and treated by extraction for 5 hours with tetrahydrofuran under the refluxing condition. After the treatment of extraction is completed, the resin remaining on the metal net is dried at 100° C. for 24 hours, conditioned for moisture in an atmosphere of a temperature of 23° C. and a RH of 50% for 3 hours or longer and weighed to obtain the weight of the resin (B g). The gel fraction is calculated in accordance with the following equation:

$$\text{Gel fraction (\%)}=(B/A)\times 100$$

The thickness of the anchor coat layer is, in general, in the range of 0.1 to 30 μm and preferably in the range of 1 to 15 μm.

In the rewritable thermal label of the present invention, a heat-sensitive color development layer is formed on the anchor coat layer formed as described above. In general, the heat-sensitive color development layer is constituted with a dye precursor which is colorless or colored slightly, a reversible color developing agent and, where necessary, a binder, a color erasure accelerator, inorganic pigments and various additives.

The dye precursor is not particularly limited and a compound can be suitably selected from conventional compounds known as the dye precursors in heat-sensitive recording materials. Examples of the dye precursor include triarylmethane-based compounds such as 3,3-bis(4-dimethylaminophenyl)-6-dimethylaminophthalide, 3-( 4-dimethylamino-phenyl)-3-(1,2-dimethylindol-3-yl)phthalide and 3-( 4-diethylamino-2-ethoxyphenyl)-3-(1-ethyl-2-methylindol-3-yl)-4-azaphthalide; xanthene-based compounds such as Rhodamine B anilinolactam and 3-(N-ethyl-N-tolyl)amino-6-methyl-7-anilinofluorane; diphenylmethane-based compounds such as 4,4'-bis(dimethylaminophenyl)benzohydrylbenzyl ether and N-chlorophenylleukoauramine; spiro compounds such as 3-methylspirodinaphthopyran and 3-ethylspirodinaphthopyran; and thiazine-based compounds such as benzoylleukomethylene blue and p-nitrobenzoylleukomethylene blue. The above compounds may be used singly or in combination of two or more.

The reversible color developing agent is not particularly limited as long as the agent makes the dye precursor exhibit a reversible change in color tone in accordance with the cooling rate after heating. From the standpoint of the concentration of the developed color, the color erasing property and the durability in repeated color development and erasure, electron-accepting compounds which are phenol derivatives having a long chain alkyl group are preferable.

The phenol derivative may have atoms such as oxygen and sulfur and the amide linkage in the molecule. The length and the number of the alkyl group are selected by taking the balance between the color erasing property and the color developing property into consideration. It is preferable that the alkyl group has 8 or more carbon atoms and more preferably 8 to 24 carbon atoms. Hydrazine compounds, anilide compounds and urea compounds having a long chain alkyl group as the side chain group can also be used.

Examples of the phenol derivative having a long chain alkyl group include 4-(N-methyl-N-octadecylsulfonylamino)phenol, N-(4-hydroxy-phenyl)-N'-n-octadecylthiourea, N-(4-hydroxyphenyl)-N'-n-octadecylurea, N-(4-hydroxyphenyl)-N'-n-octadecylthioamide, N-[3-(4-hydroxyphenyl)-propiono]-N'-octadecanohydrazide and 4'-hydroxy-4-octadecylbenzanilide.

When information is recorded or erased by utilizing crystallizability of the reversible color developing agent, the information can be repeatedly recorded by quenching after heating and erased by annealing after heating.

As the binder which is used where necessary for the object of holding the components constituting the heat-sensitive color development layer and maintaining the uniform distribution of the components, for example, polymers such as polyacrylic acid, polyacrylic esters, polyacrylamide, polyvinyl acetate, polyurethanes, polyesters, polyvinyl chloride, polyethylene, polyvinyl acetal and polyvinyl alcohol and copolymers derived from these polymers are used.

As for the components used where necessary, examples of the color erasure accelerator include ammonium salts; examples of the inorganic pigment include talc, kaolin, silica, titanium oxide, zinc oxide, magnesium carbonate and aluminum hydroxide; and examples of the other additive include leveling agents and dispersants which are conventionally used.

For forming the heat-sensitive color development layer, the dye precursor, the reversible color developing agent and various additives which are used where necessary are dissolved or dispersed in a suitable organic solvent and a coating fluid is prepared. Examples of the organic solvent include alcohol solvents, ether solvents, ester solvents, aliphatic hydrocarbon solvents and aromatic hydrocarbon solvents. Among these solvents, tetrahydrofuran is preferable due to the excellent dispersion property. The relative amounts of the dye precursor and the reversible color developing agent are not particularly limited. In general, the reversible color developing agent is used in an amount in the range of 50 to 700 parts by weight and preferably in the range of 100 to 500 parts by weight per 100 parts by weight of the dye precursor.

The coating fluid prepared as described above is applied to the anchor coat layer formed above in accordance with a conventional process. The formed coating layer is treated by drying and the heat-sensitive color development layer is formed. The temperature of the drying treatment is not particularly limited. It is preferable that the drying treatment is conducted at a low temperature to prevent color development of the dye precursor. The thickness of the heat-sensitive color development layer formed as described above is, in general, in the range of 1 to 10 μm and preferably in the range of 2 to 7 μm.

In the rewritable thermal label of the present invention, a light absorption and photo-thermal conversion layer is formed on the heat-sensitive color development layer formed as described above. In general, the light absorption and photo-thermal conversion layer is constituted with a light absorbing agent, a binder and, where necessary, inorganic pigments, antistatic agents and other additives.

The light absorbing agent has the function of absorbing the incident laser beam and converting the laser beam into heat and is suitably selected in accordance with the laser beam used. As the laser beam, it is preferable that laser beam having the wavelength of oscillation in the range of 700 to 1,500 nm is selected. For example, the semiconductor laser beam and the YAG laser beam can be preferably used.

The light absorbing agent absorbs the near infrared laser beam and generates heat. It is preferable that light in the visible region is not absorbed much. When light in the visible region is absorbed, the property of visual recognition and the property for reading the bar code deteriorate. Examples of the light absorbing agent satisfying the above requirements include organic dyes and/or organometallic coloring matters. Specific examples of the light absorbing agent include cyanine-based coloring matters, phthalocyanine-based coloring matters, anthraquinone-based coloring matters, azulene-based coloring matters, squalylium-based coloring matters, metal complex-based coloring matters, triphenylmethane-based coloring matters and indolenin-based coloring matters. Among these coloring matters, indolenin-based coloring matters are preferable due to the excellent property of photo-thermal conversion.

As the binder, the same binders as those described above as the examples of the binder in the heat-sensitive color development layer can be used. Since the light absorption and photo-thermal conversion layer is the outermost layer of the label, transparency for visualization of the color development in the lower layer and the hard coat property (resistance to scratches) of the surface are required. Therefore, as the binder, a crosslinking type resin is preferable and a resin curable with an ionizing radiation such as ultraviolet light and electron beam are more preferable.

To form the light absorption and photo-thermal conversion layer, a coating fluid comprising the light absorbing agent, the binder and various additives used where necessary is prepared. Where necessary, a suitable organic solvent may be used in this preparation depending on the type of the binder. The relative amounts of the binder and the light absorbing agent are not particularly limited. In general, the light absorbing agent is used in an amount in the range of 0.01 to 50 parts by weight and preferably in the range of 0.03 to 10 parts by weight per 100 parts by weight of the binder. However, since the light absorbing agent occasionally absorbs also light in the visible region, there is the possibility that the surface is colored when the amount of the light absorbing agent is excessively great. Since not only the appearance of the label but also visual recognition of the information and visibility of the bar code become poor when the surface is colored, it is preferable that the amount of the light absorbing agent is kept small so that the amount is in a suitable balance with the sensitivity of color development by heat generation.

The coating fluid prepared as described above is applied to the surface of the heat-sensitive color development layer described above in accordance with a conventional process. After the formed coating layer is treated by drying, the coating layer is crosslinked by heating or by irradiation with an ionizing radiation and the light absorption and photo-thermal conversion layer is formed. The thickness of the light absorption and photo-thermal conversion layer formed as described above is, in general, in the range of 0.05 to 10 μm and preferably in the range of 0.1 to 3 μm.

In the rewritable thermal label of the present invention, an adhesive layer is placed on the face of the substrate opposite to the face having the above layers. As the adhesive constituting the adhesive layer, an adhesive which exhibits the excellent adhesive property to an adherend comprising a plastic material and has a resin composition which does not adversely affect recycling when the adherend and the label are recycled together is preferable. In particular, an adhesive comprising an acrylic ester-based copolymer as the resin component is preferable due to the excellent property for recycling. Rubber-based adhesives, polyester-based adhesives and polyurethane-based adhesives can also be used. Silicone-based adhesives exhibiting excellent heat resistance may be used. However, the silicone-based adhesive has a drawback in that a resin obtained after recycling tends to become uneven due to poor compatibility of the adhesive with the adherend in the recycling process and this may cause a decrease in the strength and poor appearance.

As the adhesive, any of emulsion-type adhesives, solvent-type adhesives and adhesives without solvents can be used. It is preferable that the adhesive is the crosslinking type since water resistance in the washing step for repeated use of the adherend is excellent and durability in holding the label is also improved. The thickness of the adhesive layer is, in general, in the range of 5 to 60 μm and preferably in the range of 15 to 40 μm.

In the rewritable thermal label of the present invention, a release sheet may be placed on the adhesive layer, where necessary. As the release sheet, a release sheet prepared by coating a plastic film such as a film of polyethylene terephthalate (PET), foamed PET and polypropylene, paper laminated with polyethylene, glassine paper and clay coat paper with a releasing agent is used. As the releasing agent, silicone-based releasing agents are preferable. Fluorine-based releasing agents and releasing agents based on carbamates having a long chain alkyl group can also be used. The thickness of the coating layer of the releasing agent is, in general, in the range of 0.1 to 2.0 μm and preferably in the range of 0.5 to 1.5 μm. The thickness of the releasing sheet is not particularly limited. The thickness of the releasing sheet is, in general, in the range of about 20 to 150 μm.

As for the order of forming the layers in the rewritable thermal label of the present invention, it is preferable that the anchor coat layer, the heat-sensitive color development layer and the light absorption and photo-thermal conversion layer are formed successively in this order on one face of the substrate and, after these layers are formed, the adhesive layer is formed on the other face of the substrate.

The anchor coat layer, the heat-sensitive color development layer and the light absorption and photo-thermal conversion layer described above can be formed by applying the coating fluid for each layer in accordance with a coating process such as the direct gravure coating process, the gravure reverse coating process, the microgravure coating process and the processes using a Mayer bar, an air knife, a blade, a die or a roll knife, the reverse coating process and the curtain coating process or a printing process such as the flexo printing process, the letter press printing process and the screen printing process, drying the formed layers and, where necessary, further heating the dried layers. In particular, it is preferable that the heat-sensitive color development layer is dried at a low temperature to prevent development of the color of the layer. When the material curable with an ionizing radiation is used, the layer is cured by irradiation with an ionizing radiation.

The adhesive layer may be formed by directly applying the adhesive to the surface of the substrate in accordance with a conventional process using a roll knife coater, a reverse coater, a die coater, a gravure coater or a Mayer bar and drying the formed layer. Alternatively, the adhesive layer may be formed on the releasing surface of a release sheet by applying the adhesive in accordance with the above process and drying the formed layer and the formed adhesive layer may be transferred to the substrate by attaching the obtained laminate to the substrate. The latter process of the transfer process is preferable since the efficiency of drying the adhesive layer can be increased without causing development of the color in the heat-sensitive color development layer formed on the substrate.

FIG. 1 shows a sectional view exhibiting an embodiment of the construction of the rewritable thermal label of the non-contact type of the present invention. The rewritable thermal label of the non-contact type 10 has a construction such that an anchor coat layer 2, a heat-sensitive color development layer 3 and a light absorption and photo-thermal conversion layer 4 are laminated successively on one face of a substrate 1 and an adhesive layer 5 and a release sheet 6 are successively formed on the opposite face (the back face) of the substrate 1.

An embodiment of the use of the rewritable thermal label of the non-contact type of the present invention will be described in the following.

Before the label of the present invention is attached to an adherend, desired information is printed on the label. For the printing, the contact method in which a thermal head is brought into contact with the light absorption and photo-thermal conversion layer or the non-contact method using laser beam may be used. The printing in accordance with the non-contact method will be described in the following.

In the non-contact method, the surface of the label is irradiated with laser beam in the condition without contacting the label. The laser beam is absorbed with the light absorbing agent in the light absorption and photo-thermal conversion layer at the surface of the label and converted into heat. Due to the converted heat, the dye precursor and the reversible color developing agent in the heat-sensitive color development layer at the lower layer react with each other and the dye precursor develops color. The printing is achieved as the result. As the laser beam used above, the semiconductor laser beam and the YAG laser beam having a wavelength of oscillation in the range of 700 to 1,500 nm is preferable as described above.

It is preferable that the distance between the surface of the label and the source of laser beam is in the range of 1 μm to 30 cm although the distance is different depending on the output power of irradiation. A shorter distance is preferable from the standpoint of the output power of laser beam and the scanning. As for the diameter of the laser beam, it is preferable that the beam is concentrated to an area having a diameter of about 1 to 50 μm on the surface of the label from the standpoint of image formation. As for the scanning speed, a faster scanning is advantageous due to a shorter recording time. It is preferable that the scanning speed is 3 m/sec or faster. As for the output power of the laser beam, an output power of 50 mW or greater is necessary and an output power of about 300 to 10,000 mW is practically preferable to achieve a higher speed of printing. The face of the label opposite to the face irradiated with the laser beam is temporarily fixed by electrostatic force using a drum roll, by suction or by the like other method.

After the irradiation with laser beam, the label is quenched with cold air and an image can be obtained. When the label is cooled by being left standing without quenching, the concentration of the image decreases or the image is erased. The operation of cooling may be conducted alternately or simultaneously with the scanning with the laser beam. To stabilize the image, it is important that the temperature of the surface is lowered by quenching as described above.

The label on which the information has been recorded as described above is attached to an adherend by a mechanical or manual operation. When the label is attached by a mechanical operation, the method of pressing by a grid, the roller plunger method of pressing by a roll or the air blowing method using the air can be used.

The adherend to which the label is attach as described above is used for transportation of articles or the like. After the object of the adherend is achieved, the adherend is washed for reuse, where necessary. As the method of washing, the method of blowing with the air to remove dusts, the method of washing with water or the washing with warm alkaline water can be used.

To reuse the adherend after being used, it is necessary that the information on the attached label be replaced with a new information. For this purpose, first, the label on the adherend is heated. For the heating, a temperature in the range of about 50 to 180° C. and preferably in the range of 80 to 150° C. is advantageous. The temperature may be changed in accordance with the reversible color developing agent and the color erasure accelerator in the heat-sensitive color development layer. As the method of heating, the method of bringing into contact with a heated roll, the method of blowing hot air or the method of irradiation with laser beam can be used. After being heated, the label is slowly cooled by being left standing or by using warm air and the information is erased.

After the information has been erased, a new information is recorded in accordance with the non-contact method described above. By repeating the steps described above, the adherend and the label can be repeatedly used.

In the present invention, it is possible that the label is repeatedly used about 10 to 500 times. After the reuse of the prescribed number of times, the adherend and the label are sent to the recycling step together and subjected to the recycling treatment. Heretofore, when the adherend is recycled, it is necessary that the label be peeled off and removed since the label works as a foreign substance and the strength of the article obtained after the recycling decreases. Moreover, it is generally considered that recycling the adherend and the label together is impossible since conventional heat-sensitive color developing agents develop color by heating and cause stain. In contrast, the label of the present invention has the heat-sensitive color development system different from conventional systems and the adherend and the label can be recycled together when the same material is used for the adherend and for the substrate of the label.

To summarize the advantages of the present invention, in accordance with the present invention, the rewritable thermal label of the non-contact type which allows recording and erasure of information repeatedly while the label is adhered to the adherend, allows the use of a substrate having poor resistance to solvents and can be recycled together with the adherend is provided.

The rewritable thermal label of the non-contact type of the present invention can be used, for example, as a label attached to a plastic container used for transporting foods, a label used for control of electronic parts and a label attached to a cardboard box for control of distribution of articles.

EXAMPLES

The present invention will be described more specifically with reference to examples in the following. However, the present invention is not limited to the examples.

The degree of crosslinking of the resin in the anchor coat layer is expressed by the gel fraction measured in accordance with the method described above in the present specification.

Preparation Example 1

Preparation of a Coating Fluid for Forming a Heat-sensitive Color Development Layer (Fluid A)

A triarylmethane-based compound which was 3-(4-diethylamino-2-ethoxyphenyl)-3-(1-ethyl-2-methylindol-3-yl)-4-azaphthalide as the dye precursor in an amount of 10 parts by weight, 30 parts by weight of 4-(N-methyl-N-octadecylsulfonylamino)phenol as the reversible color developing agent, 1.5 parts by weight of polyvinyl acetal as the dispersant and 2,500 parts by weight of tetrahydrofuran were pulverized by a pulverizer and Disper to form a dispersion and a coating fluid for forming a heat-sensitive color development layer (Fluid A) was prepared.

Preparation Example 2

Preparation of a Coating Fluid for Forming a Light Absorption and Photo-thermal Conversion Layer (Fluid B)

A light absorption and photo-thermal conversion agent (an indolenin-based coloring matter) [manufactured by NIPPON HASSHOKU SHIKISO Co., Ltd.; the trade name: NK-2014] in an amount of 5 parts by weight, 100 parts by weight of a binder of the ultraviolet light curing type (a urethane acrylate-based binder) [manufactured by DAINICHI-SEIKA COLOR & CHEMICALS MFG. Co., Ltd.; the trade name: PU-5 (NS) and 3 parts by weight of an inorganic pigment (silica) [manufactured by NIPPON AEROSIL KOGYO Co., Ltd.; the trade name: AEROSIL R-972] were dispersed by Disper and a coating fluid for forming a light absorption and photo-thermal conversion layer (Fluid B) was prepared.

Example 1

A coating fluid for forming an anchor coat layer (Fluid C-1) which was an acrylic emulsion of the crosslinking type containing 100 parts by weight of an emulsion of an acrylic copolymer [manufactured by SHIN NAKAMURA KAGAKU KOGYO Co., Ltd.; the trade name: NEW COAT TS-1016] and 2 parts by weight of an epoxy crosslinking agent [manufactured by SAIDEN KAGAKU Co., Ltd.; the trade name: E-104] was prepared.

One face of a substrate film which was an ABS film [manufactured by SHIN-ETSU POLYMER Co., Ltd.; the trade name: PSZ980] having a thickness of 80 μm was coated with Fluid C-1 prepared above in accordance with the direct gravure coating process in an amount such that a layer having a thickness of 3 μm was formed after being dried. The formed layer was dried in an oven at 60° C. for 3 minutes and an anchor coat layer was formed. The gel fraction of the crosslinked resin in the anchor coat layer was 52%.

The formed anchor coat layer was then coated with Fluid A obtained in Preparation Example 1 in accordance with the gravure coating process in an amount such that a layer having a thickness of 4 μm was formed after being dried. The formed layer was dried in an oven at 60° C. for 5 minutes and a heat-sensitive color development layer was formed. The formed heat-sensitive color development layer was coated with Fluid B obtained in Preparation Example 2 in accordance with the flexo coating process in an amount such that a layer having a thickness of 1.2 μm was formed after being dried. The formed layer was irradiated with ultraviolet light to form a light absorbing and photo-thermal conversion layer and a member for a label was prepared.

When Fluid A was applied to the anchor coat layer, it was visually examined whether the substrate film was dissolved with the coating fluid.

A polyethylene terephthalate film having a thickness of 50 μm [manufactured by TORAY Co., Ltd.; the trade name: LUMILAR T TYPE] was coated with a silicone resin containing a catalyst [manufactured by TORAY-DOW CORNING Co., Ltd.; the trade name: SRX-211] in an amount such that a layer having a thickness of 0.7 μm was formed after being dried. The formed layer was dried and a release sheet was prepared. The face of the release sheet which was coated with the silicone resin was coated with an adhesive coating fluid prepared by adding 3 parts by weight of a crosslinking agent [manufactured by NIPPON POLYURETHANE Co., Ltd.; the trade name: CORONATE L] to 100 parts by weight of an acrylic adhesive [manufactured by TOYO INK SEIZO Co., Ltd.; the trade name: BPS-1109] in accordance with the process using a roll knife coater in an amount such that a layer having a thickness of 30 μm was formed after being dried. After the formed layer was dried in an oven at 60° C. for 5 minutes, the obtained sheet was attached to the back face of the member for a label by a laminator. The obtained laminate was wound and a material sheet of labels was obtained. The material sheet was slit into rolls having a width of 100 mm by a slitter and labels having a size of 100 mm×100 mm were prepared. The prepared labels were used as the samples for printing.

The printing was conducted by irradiation of the label with laser beam using a machine for irradiation with the semiconductor laser beam (830 nm) having an output power of 500 mW at a distance of 100 mm in a manner such that the laser beam was focussed to an area having a diameter of 12 μm at the surface of the label and the applied energy was adjusted to 1,300 mJ/cm. Immediately after the printing, the label was exposed to a cold air stream so that the printed image was maintained.

After the printing was completed, the label was attached to an adherend which was an ABS container. After the container attached with the label was left standing for 7 days, the label was exposed to an air stream heated at 130° C. for 20 seconds. Then the container attached with the label was left standing in the environment of the ordinary temperature to cool down and the printed image was erased.

After the printing and the erasure described above were repeated 10 times, the following recycling test was conducted.

<Recycling Test>

An adherend to which a label in an amount of 1% by volume was attached was melted at a temperature of 240° C. The melted material was used for molding and a recycled ABS film was prepared. The mechanical properties of the prepared ABS film were measured and the appearance of the prepared ABS film was evaluated. The property for recycling was evaluated based on the obtained results. The tensile strength was measured in accordance with the method of ASTM D638. The elongation was measured in accordance with the method of ASTM D638. The Izod impact strength was measured in accordance with the method of ASTM D256.

The results are shown in Table 1.

Example 2

The same procedures as those conducted in Example 1 were conducted except that Fluid C-2 described in the following was used in place of the coating fluid for forming an anchor coat layer (fluid C-1). The results are shown in Table 1.

<Preparation of a Coating Fluid for Forming an Anchor Coat Layer (Fluid C-2)>

A coating fluid for forming an anchor coat layer (Fluid C-2) which was an aqueous solution of a polyester of the crosslinking type containing 100 parts by weight of an aqueous solution of a polyester resin [manufactured by NIPPON GOSEI KAGAKU KOGYO Co., Ltd.; the trade name: POLYESTER WR-961] and 2 parts by weight of an epoxy crosslinking agent [manufactured by SAIDEN KAGAKU Co., Ltd.: the trade name: E-104] was prepared.

The gel fraction of the crosslinked resin in the anchor coat layer was 42%.

Example 3

The same procedures as those conducted in Example 1 were conducted except that a coating fluid for forming an anchor coat layer which was an aqueous solution of a polyurethane of the thermal self-crosslinking type containing a polyurethane resin [manufactured by DAIICHI KOGYO SEIYAKU Co., Ltd.; the trade name: ELASTORON H38] was used in place of the coating fluid for forming an anchor coat layer (Fluid C-1). The results are shown in Table 1.

The gel fraction of the crosslinked resin in the anchor coat layer was 59%.

Comparative Example 1

The same procedures as those conducted in Example 1 were conducted except that no anchor coat layer was formed. The results are shown in Table 1.

Comparative Example 2

The same procedures as those conducted in Example 1 were conducted except that no crosslinking agents were used for the preparation of the coating fluid for forming an anchor coat layer (Fluid C-1). The results are shown in Table 1.

Comparative Example 3

In the procedures conducted in Example 1, a conventional thermal paper [manufactured by NIPPON SEISHI Co., Ltd.; the trade name: TL69KS] which could not be rewritten was used as the member for a label and the same procedures as those conducted in Example 1 were conducted thereafter. The results are shown in Table 1.

TABLE 1

| | Property for forming heat-sensitive color development layer or type of member for label | Repeated recording | Removal of label for recycling | Property for recycling (physical properties of recycled film) tensile strength ($N/cm^2$) | elongation (%) | Izod impact strength (N · cm/cm) | Appearance |
|---|---|---|---|---|---|---|---|
| Example 1 | good | possible | not necessary | 956 | 113 | 929 | good |
| Example 2 | good | possible | not necessary | 920 | 109 | 862 | good |
| Example 3 | good | possible | not necessary | 935 | 111 | 882 | good |
| Comparative Example 1 | poor | evaluation not possible | evaluation not possible | — | — | — | — |
| Comparative Example 2 | poor | evaluation not possible | evaluation not possible | — | — | — | — |
| Comparative Example 3 | conventional thermal paper | not possible | necessary | 710 | 83 | 798 | poor (foreign substances) |
| No label attached | — | — | — | 960 | 114 | 931 | good |

In Examples 1 to 3, the formation of the heat-sensitive color development layer was excellent, repeated recording could be made, the operation of removing the label was not necessary for recycling and the property for recycling was excellent. In contrast, in Comparative Example 1, the formation of the heat-sensitive color development layer was poor due to the absence of the anchor coat layer. In Comparative Example 2, the formation of the heat-sensitive color development layer was poor since the anchor coat layer was made of the resin which was not crosslinked. In Comparative Example 3, the strength of the recycled film was small and the appearance of the recycled film was poor since the recycling was conducted while the label using the conventional thermal paper was attached to the adherend. The label of Comparative Example 3 prepared by using the conventional thermal paper could be printed only once.

What is claimed is:

1. A method for using a rewritable thermal label of a non-contact type which comprises recording and erasing information repeatedly in accordance with a non-contact method on a rewritable thermal label which remains attached to an adherend, said label comprising:

(a) an anchor coat layer comprising a crosslinked resin having a degree of crosslinking expressed as a gel fraction of 30% or more, said resin being selected from the group consisting of an acrylic resin, a polyester resin, a polyurethane resin and an ethylene-vinyl acetate copolymer which is crosslinked and said anchor coat layer being formed by using a coating fluid selected from the group consisting of a coating fluid without solvent, a coating fluid of an aqueous solution and an aqueous dispersion;

(b) a heat-sensitive color development layer comprising a dye precursor and a reversible color developing agent, said heat-sensitive color development layer being formed using a coating fluid which is obtained by dissolving or dispersing said dye precursor and said reversible color developing agent in an organic solvent, said dye precursor being at least one compound selected from the group consisting of:

(i) a triarylmethane compound selected from the group consisting of 3, 3-bis (4-dimethylaminophenyl)-6- dimethylaminophthalide, 3- (4-dimethylaminophenyl) -3- (1, 2-dimethylindol-3-yl) phthalide and 3- (4- diethylamino-2-ethoxyphenyl) -3- (1-ethyl- 2-methylindol-3-yl) 4-azaphthalide;

(ii) a xanthene compound selected from the group consisting of Rhodamine B anilinolactam and 3-(N-ethyl-N-tolyl)amino-6- methyl-7-anilinofluorane;

(iii) a diphenylmethane compound selected from the group consisting of 4, 4'-bis(dimethylaminophenyl) benzohydrylbenzyl ether and N-chlorophenylleukoauramine;

(iv) a spiro compound selected from the group consisting of 3-methylspirodinaphthopyran and 3-ethylspirodinaphthopyran; and (v) a thiazine compound selected from the group consisting of benzoylleukomethylene blue and p-nitrobenzoylleukomethylene blue;

said reversible color developing agent being at least one compound selected from the group consisting of 4-(N-methyl-octadecylsulfonylamino) phenol, N- (4-hydroxyphenyl) -N'-n-octadecylthiourea, N- ( 4-hydroxyphenyl) -N'-n-octadecylurea, N- (4-hydroxyphenyl) -N'-n-octadecylthioamide, N- 3- (4-hydroxyphenyl) -propionol-N'-octadecanohydrazide and 4'-hydroxy-4-octadecylbenzanilide;

and wherein said reversible color developing agent is contained in an amount of 50 to 700 parts by weight per 100 parts by weight of the dye precursor; and (c) a light absorption and photo-thermal conversion layer comprising (i) at least one light absorbing agent selected from the group consisting of a cyanine coloring matter, a phthalocyanine coloring matter, an anthraquinone coloring matter, an azulene coloring matter, a squalylium coloring matter, a metal complex coloring matter, a triphenylmethane coloring matter and an indolenin coloring matter, and (ii) a binder curable by an ionizing radiation selected from the group consisting of ultraviolet light and an electron beam, said layer (c) being cured by said radiation;

said layers (a), (b) and (c) being laminated on a first face of a substrate successively, said layer (a) being placed next to the substrate, and said layer (c) being an outermost layer; and (d) an adhesive layer placed on a second face of the substrate, said substrate being a film selected from the group consisting of a polystyrene film, an ABS resin film and a polvcarbonate film, and said substrate having a thickness of 10 to 500 μm.

2. The method according to claim 1, wherein the information is recorded with a laser beam having a wavelength of oscillation of 700 to 1,500 nm.

3. The method according to claim 1, wherein said layer (c) further comprises a binder which is a polymer selected from the group consisting of polyacrylic acid, a polyacrylic ester, polyacrylamide, polyvinyl acetate, a polyurethane, a polyester, polyvinyl chloride, polyethylene, polyvinyl acetal, polyvinyl alcohol and a copolymer derived from said polymer.

4. The method according to claim 3, wherein the light absorbing agent is contained in an amount of 0.01 to 50 parts by weight per 100 parts by weight of the binder.

5. The method according to claim 4, wherein the thickness of the substrate film is 10 to 500 μm.

6. The method according to claim 5, wherein the thickness of said layer (a) is 0.1 to 30 μm.

7. The method according to claim 6, wherein the thickness of said layer (b) is 1 to 10 μm.

8. The method according to claim 7, wherein the thickness of said layer (c) is 0.05 to 10 μm.

9. The method according to claim 8, wherein the light absorbing agent is an indolenin coloring matter.

10. The method according to claim 9, wherein the indolenin coloring matter is contained in an amount of 0.01 to 50 parts by weight per 100 parts by weight of the binder.

11. The method according to claim 10, wherein the substrate is made of the same material as the material of the adherend.

12. The method according to claim 10, wherein said layer (d) comprises an adhesive comprising an acrylic ester copolymer which is cured.

13. The method according to claim 12, wherein the binder is a urethane-acrylate binder curable by ultraviolet light.

14. The method according to claim 13, wherein the dye precursor is 3-(4-diethylamino-2-ethoxyphenyl)-3-(1-ethyl-2-methylindol-3-yl)-4-azaphthalide.

15. The method according to claim 14, wherein the reversible color developing agent is 4-(N-methyl-N-octadecylsulfonylamino)phenol.

16. The method according to claim 15, wherein the crosslinked resin of layer (a) is an acrylic copolymer crosslinked with an epoxy crosslinking agent.

17. The method according to claim 1, wherein the substrate is made of the same material as the material of the adherend.

18. The method according to claim 1, wherein said layer (d) comprises an adhesive selected from the group consisting of an adhesive comprising an acrylic ester copolymer, a rubber adhesive, a polyester adhesive and a polyurethane adhesive.

19. The method according to claim 18, wherein said layer (d) comprises an adhesive comprising an acrylic ester copolymer.

20. The method according to claim 1, wherein said layer (d) comprises an adhesive comprising an acrylic ester copolymer.

21. The method according to claim 1, wherein the recording and erasing information repeatedly is conducted by the steps of (a) printing information on the label by a non-contact method using a laser beam, (b) quenching the label on which an information is printed to obtain an image, (c) attaching the label on which the image is obtained to an adherend, (d) heating the label by irradiating using a laser beam after the use of said adherend, (e) slowly cooling the label to erase the information, (f) recording new information in accordance with the non-contact method set forth in steps (a) and (b), and (g) repeating the steps (d) to (f).

22. The method according to claim 1, wherein the light absorbing agent in the light absorption and photo-thermal conversion layer is at least one agent selected from the group consisting of a phthalocyanine coloring matter, an anthraquinone coloring matter, an azulene coloring matter, a squalylium coloring matter, a metal complex coloring matter and an indolenin coloring matter.

* * * * *